United States Patent [19]

Popov

[11] 4,407,504

[45] Oct. 4, 1983

[54] AMUSEMENT DEVICE

[76] Inventor: Richard Popov, Bldg., Apt. 5, 60 North Street, Marcellus, N.Y. 13108

[21] Appl. No.: 286,031

[22] Filed: Jul. 22, 1981

[51] Int. Cl.[3] ..... A63F 9/06; A63H 3/16

[52] U.S. Cl. ..... 273/153 R; 46/146; 70/288; 70/312; 70/318; 206/1.5; 220/377

[58] Field of Search ..... 273/153 R, 156; 46/146; 70/288, 312, 316, 317, 318; 206/1.5; 220/377

[56] References Cited

U.S. PATENT DOCUMENTS

| | | | |
|---|---|---|---|
| 163,767 | 5/1875 | Grah | 70/316 |
| 571,477 | 11/1896 | Howlett | 273/153 R |
| 877,682 | 1/1908 | Turman | 70/318 |
| 2,512,028 | 6/1950 | MacMillan | 206/1.5 X |
| 3,012,366 | 12/1961 | Faulkner | 46/146 |
| 3,324,997 | 6/1967 | Bonanno | 220/377 X |
| 3,677,042 | 7/1972 | Atkinson | 70/312 |

*Primary Examiner*—Anton O. Oechsle
*Attorney, Agent, or Firm*—Don E. Ferrell

[57] ABSTRACT

An amusement device consists of a box-like structure having a transparent lid which may be opened through the proper positioning of a plurality of tumblers contained on an exterior face of the structure. The transparent lid is of a spring biased construction to facilitate its opening once the proper combination on the tumblers has been set, and a troll-like figurine is releaseable from an interior portion of the structure upon an opening of the lid. If desired, the troll may be provided with an award deliverable to the bearer. Further, the combination required to open the structure is changeable through the use of selectively positionable gears associated with the tumblers.

6 Claims, 5 Drawing Figures

FIG. 1
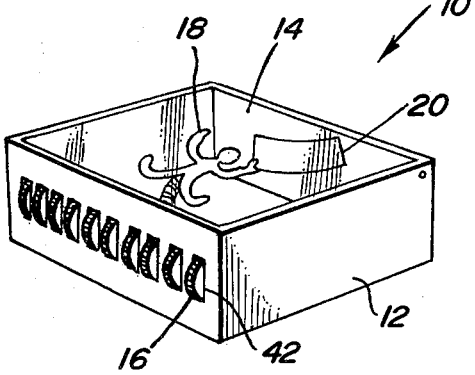
FIG. 2
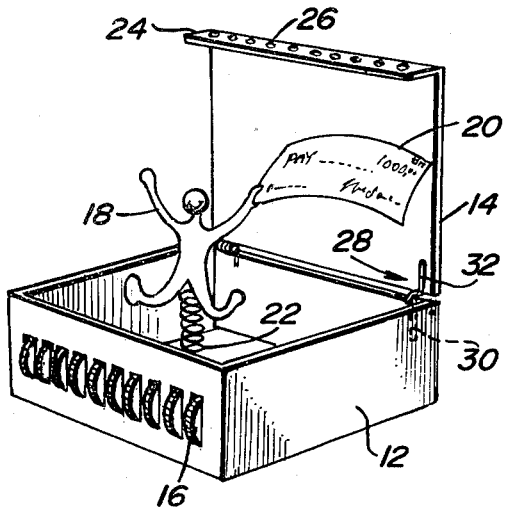
FIG. 3
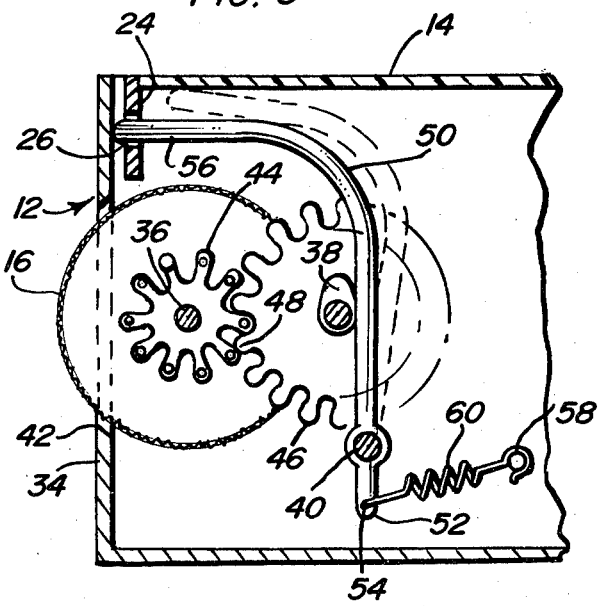
FIG. 4
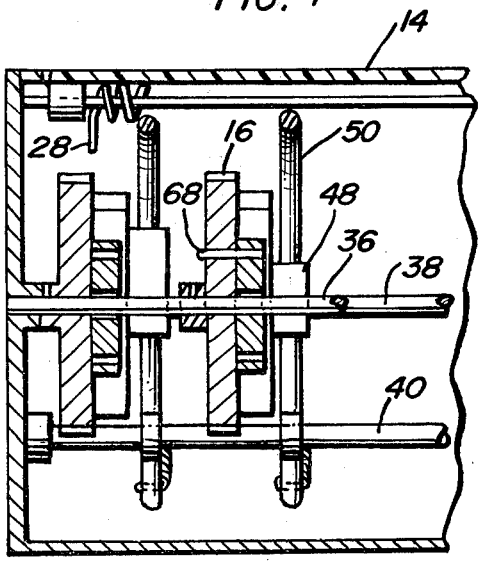
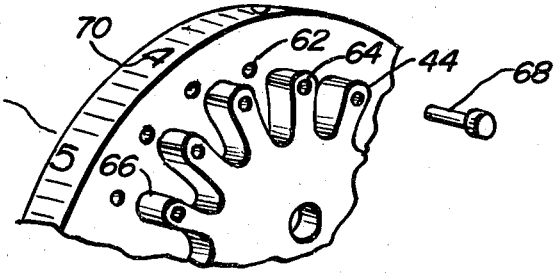
FIG. 5

AMUSEMENT DEVICE

BACKGROUND OF THE INVENTION

1. Field of the Invention

The present invention relates generally to amusement devices, such as toys, games and the like, and more particularly pertains to a new and improved amusement device which includes a locked box structure openable in response to a proper combination of tumblers being achieved and having an incentive award contained therein obtainable in response to an unlocking of the structure.

2. Description of the Prior Art

The use of amusement devices which include the use of tumblers for achieving a proper combination to effect a desired result is well known in the art. In this respect, reference is made to U.S. Pat. No. 3,411,786, which issued to J. Cooper on Nov. 19, 1968, wherein a toy container with a randomly unlatchable lid is disclosed. The Cooper device includes a spring biased lid which is latched in a closed position and an unlatching mechanism selectively operated by only one of six levers, along with means which randomly selects which lever is effective to operate the unlatching mechanism. In this regard, a rotary wheel is provided on an exterior surface of the container and as a result of a manual rotation of this wheel, the unlatching mechanism is effectively varied in a manner which changes the particular lever that will effectively operate the same. Further, the unlatchable lid is provided with an opening in a central portion thereof, whereby tokens, coins, or the like, may be deposited into the container, such tokens, coins, and the like being retrievable only by an unlatching of the lid through a proper lever selection.

While the Cooper container effectively discloses the concept of providing a box-like device having a randomly unlatchable lid, it can be appreciated that substantial room exists for improvement in the construction and function of such devices whereby the amusement value could be substantially enhanced and in this regard, the present invention substantially fulfills this need.

SUMMARY OF THE INVENTION

The general purpose of the present invention, which will be described subsequently in greater detail, is to provide a new and improved amusement device having a randomly unlatchable lid which has all the advantages of similar prior art amusement devices and none of the disadvantages. To attain this, the present invention provides for a container with a randomly unlatchable lid, with such lid being of transparent construction whereby a viewing of the interior portion of the container is possible. In a preferred embodiment, it is envisioned that a troll-like figurine may be provided within the interior portion of the container, such figurine being mounted upon a spring which will permit the same to spring out of the container upon an opening of the lid. Additionally, the figurine may contain a restrictively drawn check, monetary award, or other incentive deliverable to a person who successfully opens the container. A plurality of tumblers are provided as the means of controlling the unlatching of the lid, with such tumblers being provided with various numbers thereon, whereby a proper sequencing of the numbers will result in the lid being unlatched and spring-biasedly opened.

Additionally disclosed is a mechanism whereby the opening combination or setting of the respective tumblers may be quickly and easily changed. In this regard, each tumbler is rotatably mounted upon a first support shaft and further has a gear fixedly secured thereto in an abutting relationship therewith and also being mounted in a rotatable manner upon the same support shaft. Each gear is provided with a pin selectively positionable through the gear in a direction axially aligned with the support shaft and being further engageable with a plurality of apertures circuitously positioned in the particular tumbler. Effectively, once the pin is inserted through the particular gear and tumbler, a fixed securement therebetween is achieved whereby the gear and tumbler rotate concurrently on the support shaft. If it is desired to change the setting of the tumbler which will effect an unlatching of the lid, the pin need only be withdrawn from the tumbler and gear whereby relative rotation between the tumbler and gear can be achieved to effectively change the tumbler setting. The pin may then be reinserted to fixedly secure the gear and tumbler together again. By the same token, each gear associated with each particular tumbler is operably engageable with a second gear rotatably mounted to a second support shaft. Each second gear is provided with a cam member in fixed securement therewith whereby upon a rotation of the second gear in response to a concurrent rotation of the first gear, the cam member will operate to move a locking rod rotatably mounted on a third support shaft into and out of engagement with a locking aperture contained on the lip portion of the lid. In this connection, the cam member will effectively push the locking rod out of engagement with the locking aperture only when the precise number contained on an exterior circumferential surface of the tumbler is moved into a proper position. As can be appreciated, all of the locking levers associated with each of the respective tumblers must be moved out of their locking position before the lid may be spring-biasedly opened.

It is therefore an object of the present invention to provide an improved amusement device having a randomly unlatchable lid that has all of the advantages of the prior art amusement devices with randomly unlatchable lids and none of the disadvantages.

It is another object of the present invention to provide a new and improved amusement device having a randomly unlatchable lid which may be easily and economically manufactured.

It is a further object of the present invention to provide a new and improved amusement device having a randomly unlatchable lid which may be efficiently and reliably operated.

Even another object of the present invention is to provide a new and improved amusement device having a randomly unlatchable lid which is of a durable and rugged construction.

Still another object of the present invention is to provide a new and improved amusement device having a randomly unlatchable lid which is easy to use and which may be easily repaired in case of a malfunction.

Yet another object of the present invention is to provide a new and improved amusement device having a randomly unlatchable lid which is of a portable and lightweight construction.

An even further object of the present invention is to provide a new and improved amusement device having a randomly unlatchable lid which utilizes a combination setting to effectuate an opening of said lid and which further provides a means for selectively and easily changing said combination setting.

Still yet another object of the present invention is to provide a new and improved amusement device having a randomly unlatchable lid which provides in the apparatus of the prior art some of the advantages thereof, while simultaneously overcoming some of the disadvantages normally associated therewith.

These together with other objects of the invention, along with various features of novelty which characterize the invention, are pointed out with particularity in the claims annexed to and forming a part of this disclosure. For a better understanding of the invention, its operating advantages and specific objects attained by its uses, reference should be had to the accompanying drawings and descriptive matter in which there is illustrated a preferred embodiment of the invention.

BRIEF DESCRIPTION OF THE DRAWINGS

FIG. 1 is a perspective view of the amusement device having a randomly unlatchable lid forming the present invention.

FIG. 2 is a perspective view of the present invention showing the device with its lid in an unlatched position.

FIG. 3 is a side elevation view, partly in cross-section, illustrating the unlatching mechanism associated with the invention.

FIG. 4 is a front plan view of the present invention, partly in cross-section, illustrating further constructional details of the latching mechanism associated therewith.

FIG. 5 is a detailed perspective view, showing the manner of selectively changing the combination setting of the invention.

DESCRIPTION OF THE PREFERRED EMBODIMENT

With reference now to the drawings and in particular to FIG. 1 thereof, a new and improved amusement device having a randomly unlatchable lid embodying the principles and concepts of the present invention and generally designated by the reference numeral 10 will be described. In this regard, it can be seen that the amusement device 10 includes a box-like structure 12 having a transparent lid 14 which is randomly unlatchable in response to a proper setting being obtained on a plurality of tumblers, generally designated by the reference numeral 16. Further illustrated in FIG. 1 is the fact that a troll-like figurine 18 may be retained within the box 12 below the transparent lid 14, such figurine carrying, or otherwise having attached thereto, a restrictively drawn check 20 or other incentive award as desired.

As shown in FIG. 2 of the drawings, the figurine 18 is retained within the box 12 by a spring 22 having one end thereof fixedly secured to a bottommost interior portion of the box and having its other end fixedly secured to the figurine. As can be appreciated with reference to this figure, the spring 22 is so positioned as to effect an upward extending of the figurine 18 once the lid 14 is moved into its opened or unlatched position.

Further illustrated in FIG. 2 is the fact that the lid 14 has a forwardly positioned, downwardly extending lip portion 24, such lip portion including a plurality of apertures, generally designated by the reference numeral 26, directed therethrough. Additionally, a conventional spring means 28 is disclosed which is operable to effect an opening of the lid 14 in a well known manner once the lid has been unlatched by a proper setting of the tumblers 16. In this respect, the spring 28 is of a coiled construction having two free extending ends 30, 32, with one of such ends 30 being attachable to or abuttable with an interior back wall portion of the box 12 and with the other free end 32 being securable to or abuttable with an interior surface of the lid 14. Due to a coiled biasing of the spring 28, the ends 30, 32 tend to move towards axial, substantially parallel alignment when the lid 14 is unlatched, thereby to effect a desired opening of the lid in the manner illustrated.

Referring next to FIGS. 3–5 of the drawings, the unlatching mechanism associated with the present invention will be described. In this regard, FIG. 3 shows the box 12 with the lid 14 in a closed, latched position whereby the downwardly extending lip portion 24 is contained substantially being a front wall portion 34 of the box 12.

Further illustrated is a plurality of longitudinally extending, substantially paralleledly aligned support shafts 36, 38, 40 fixedly secured proximate to the front wall portion 34 of the box 12, such shafts each having rotatably mounted thereto particular components associated with the present invention. In this respect, the front wall portion 34 of the box 12 is provided with a plurality of rectangularly shaped apertures, generally designated by the reference numeral 42 and as also shown in FIG. 1 of the drawings, such apertures permitting an outward extension of the respective tumblers 16 which are rotatably mounted on the support shaft 36. In this connection, the tumblers 16 may each be provided with a circumferentially extending serrated or roughened surface to facilitate a manual rotation thereof about the support shaft 36, and are further provided with a plurality of numbers, such as 0–9, along the circumferential surface thereof as best shown in FIG. 5, thereby to permit the selective positioning of the tumblers as desired.

As further illustrated in FIG. 3, each tumbler 16 has a gear 44 positioned in an abutting relationship therewith and being similarly rotatably mounted upon the support shaft 36. Each gear 44 is fixedly secured to its respective tumbler 16 so as to be concurrently rotatable therewith about the support shaft 36 in response to a desired rotation of the tumbler by a user of the amusement device 10. By the same token, each gear 44 is operably engageable with a second gear 46 rotatably mounted upon support shaft 38. In this regard, each gear 46 has operably secured in an abutting relationship therewith a cam 48 concurrently rotatable with the gear 46 upon the support shaft 38.

As further shown in FIGS. 3 and 4, each of the respective cams 48 are slidingly engageable with an unlatching rod 50 operably rotatably mounted on the support shaft 40. Specifically, each unlatching rod 50 is of a L-shaped construction with one free end 52 being formed with an aperture 54 contained therein, and with the other free end 56 being engageable with a respective one of the aforedescribed apertures 26 formed on the lip portion 24 of the lid 14. As shown, a fourth support shaft or cross-extending wire 58, or some other conventional attachment means, may be employed to facilitate an interconnection of a plurality of springs 60 between such support means 58 and the aperture 54 associated with the end 52 of each unlatching rod 50. In this connection, it can be appreciated that the respective springs 60 will tend to cause a counterclockwise rotation of their associated unlatching rod 50 about the support shaft 40 due to a tensioning thereof between the aperture 54 and the support means 58. Such a counterclockwise movement of each unlatching rod 50, of course, results in the end 56 of each respective rod moving into locking engagement with the apertures 26 positioned on the lip portion 24 of the lid 14. By the same token, it is evident that a rotation of the cam 48 about the support shaft 38 concurrently with the gear 46 will result in a clockwise movement of the unlatching rod 50 about the support shaft 40 against the biasing force of the spring 60. This clockwise movement will effect an unlatching of the rod 50 through a movement of the end 56 thereof out of engagement with the aperture 26 in the manner illustrated.

FIG. 5 illustrates the specific attachment means utilized between the respective tumblers 16 and their associated gears 44. In this connection, it can be seen that each tumbler 16 may be provided with a plurality of circuitously positioned, axially extending apertures 62, such apertures being respectively alignable with a plurality of axially extending apertures 64 contained on remote ends of the gear teeth 66 associated with the gear 44. A pin 68 may then be employed to effect a secure attachment between the gears 44 and their associated tumblers 16 by directing the same through aligned apertures 64, 62 in the manner shown. By the same token, the pin 68 may be conveniently and quickly removed from the apertures 62, 64, to permit relative rotation between a particular gear 44 and its associated tumbler 16, thereby to effect the positioning of the numbers 70 located on the circumferential surface of the tumblers, thus to change the combination setting required for effecting an unlatching of the lid 14 in the manner above described.

In operation then, it can be seen that it is expected to present the amusement device 10 to a user with the lid 14 in a latched position, the troll-like figurine 18 being contained within an interior portion of the box 12 and an incentive, such as check 20, being attached to the figurine. Upon the proper sequencing of the plurality of tumblers 16, which are illustrated as being ten in number wherein it is to be understood that the tumblers could be of any varying number, each of the respective unlatching rods 50, as shown in FIGS. 3 and 4, will be removed from engagement with the apertures 26 associated with the lip portion 24 of the lid 14. Once all of the unlatching rods 50 are removed from engagement with their respective apertures 26, the spring 28 will operate to effect an opening of the lid 14 in the illustrated manner of FIG. 2, thereby to permit the figurine 18 to extend outwardly from the interior of the box 12 through the use of spring 22. Accordingly, the user of the amusement device may then obtain possession of the incentive award 20.

Once the combination of the amusement device has become a matter of knowledge to one or more users, one or more pins 68 can be removed from their respective gears 44 and tumblers 16, thereby to permit relative rotation of the tumblers 16 so as to change the combination numbering 70 required to effect an unlatching of the lid 14. Once the relative rotation has been accomplished, the pins 68 may be reinserted through the aligned apertures 62, 64 contained respectively on the tumblers and gears 16, 44, thereby to securely lock in the new combination required to effect an unlatching of the lid 14 in the above described manner.

With respect to the above description then, it should be realized that the optimum dimensional relationships for the parts of the invention, to include variations in size, shape, form, function and manner of operation, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new and desired to be secured by Letters Patent of the United States is as follows:

1. An amusement device comprising:

housing means having a transparent lid means associated therewith for permitting a viewing into an interior portion of said housing means;

a plurality of latching means operably associated with said housing means and serving to retain said lid means in a normally latched closed position;

tumbler means selectively positionable to effect an unlatching of said latching means, thereby to effect a release of said lid means whereby said lid means may be moved into an open position so as to permit access to said interior portion of said housing means, said tumbler means being positionable on an exterior surface of said housing means, said tumbler means including a plurality of rotatable tumblers having positioning indicia on external surfaces thereof, whereby a proper positioning of said indicia will effect said unlatching of said lid means;

first gear means fixedly secured to said tumbler means, said first gear means including a plurality of first gears one each of which is respectively associated with one of said plurality of said tumblers, whereby a rotation of a respective one of said plurality of said tumblers will effect a concurrent rotation of a respective associated first gear;

first support shaft means rotatably mounted in said housing means, said first support shaft means having said tumbler means and said first gear means mounted thereon;

second support shaft means rotatably mounted in said housing means;

second gear means fixedly mounted on said second support shaft means, said second gear means including a plurality of second gears each of which is in a respective meshing driving relationship with one of said first gears, whereby a rotation of a respective one of said first gears will effect a concurrent rotation of a respective one of said second gears;

third support shaft means rotatably mounted in said housing means, said plurality of latching means being rotatably and spring-biasedly mounted on said third support shaft means;

cam means fixedly secured to said second support shaft means, said cam means being rotatable with said second gear means and being in slidable engagement with said latching means, thereby to control a positioning of said latching means with respect to said lid means; and locking means for selectively fixedly securing said first gear means and said tumbler means in a fixed relationship, said locking means including a use of a selectively removable pin in each of said first gears, said removable pin being positionable in aligned apertures respectively contained in each of said first gears and said tumblers, whereby relative rotation between each of said first gears and said tumblers is prevented when said removable pin is in position and relative rotation between each of said first gears and said tumblers is permitted when said removable pin has been selectively removed from said aligned apertures, thereby to permit a selective changing of indicia positioning necessary to effect an unlatching of said lid means by permitting a selective relative rotation between each of said first gear means and said tumblers when desired.

2. The amusement device as described in claim 1, and further including a figurine means positioned within said interior portion of said housing means, said figurine means being spring-biasedly retained within said interior portion and being operable to extend outwardly from said interior portion upon an opening of said transparent lid means.

3. The amusement device as described in claim 1, and further including a spring biasing means for effecting a rapid opening of said transparent lid means after said lid means has been unlatched from said latching means.

4. The amusement device as described in claim 1, wherein said plurality of latching means include L-shaped latching rods rotatably mounted on said third support shaft means.

5. The amusement device as described in claim 4, wherein first ends of said plurality of said latching rods are engagable with said transparent lid means and second ends of said plurality of said latching rods have springs attached thereto to effect a desired rotation of said latching rods into a normal locking engagement with said lid means.

6. The amusement device as described in claim 1, wherein said apertures associated with said first gear means are positioned in gear teeth associated with each of said first gears.

* * * * *